United States Patent [19]

Fukushima et al.

[11] 4,279,495

[45] Jul. 21, 1981

[54] PHOTOSENSITIVE MATERIAL PROCESSING APPARATUS

[75] Inventors: Osamu Fukushima; Atsushi Shiraishi, both of Minami-ashigara, Japan

[73] Assignee: Fuji Photo Film Co., Ltd., Minami-ashigara, Japan

[21] Appl. No.: 132,610

[22] Filed: Mar. 21, 1980

[30] Foreign Application Priority Data

Apr. 2, 1979 [JP] Japan ..... 54-39499

[51] Int. Cl.[3] ..... G03D 3/13

[52] U.S. Cl. ..... 354/321; 134/64 P; 226/189; 226/190

[58] Field of Search ..... 354/319, 320, 321, 322, 354/339; 134/64 P, 122 P; 226/189, 190, 180, 181, 188; 271/270, 272, 273, 274

[56] References Cited

U.S. PATENT DOCUMENTS

| | | | |
|---|---|---|---|
| 2,146,170 | 2/1939 | Brenbarger et al. | 354/339 |
| 2,631,847 | 3/1953 | Hornberger | 226/189 |
| 3,072,310 | 1/1963 | Kunz | 226/189 |
| 3,107,036 | 10/1963 | Richards et al. | 226/180 |
| 3,366,025 | 1/1968 | Layne | 226/189 |
| 3,615,061 | 6/1969 | Bagdasarian | 354/339 |
| 3,858,870 | 1/1975 | Yabe et al. | 271/272 |

FOREIGN PATENT DOCUMENTS

| | | | |
|---|---|---|---|
| 2532827 | 10/1977 | Fed. Rep. of Germany | 354/321 |
| 1386054 | 12/1964 | France | 354/339 |
| 456346 | 7/1968 | Switzerland | 354/339 |

*Primary Examiner*—L. T. Hix
*Assistant Examiner*—Alan Mathews
*Attorney, Agent, or Firm*—Sughrue, Mion, Zinn, Macpeak and Seas

[57] ABSTRACT

A processing apparatus such as may be used for photographic film in which the films passed through several different processing sections in succession with the tension of the film web maintained constant at all times. Pairs of rollers are arranged at short intervals in succession through the various processing sections. The speed of conveyance of the web is increased in succession by driving the rollers at different speed or providing rollers of increasing diameter in the direction of the process outlet. One roller of each pair of rollers is provided with a stepped section having a height approximating the thickness of the web being conveyed. With this construction, a meandering correcting force is exerted on the web which overcomes the frictional force between the web and rollers thereby correcting any meandering of the web and maintaining the tension applied to the web at a value less than the strength of the web.

8 Claims, 5 Drawing Figures

PHOTOSENSITIVE MATERIAL PROCESSING APPARATUS

BACKGROUND OF THE INVENTION

The present invention relates to a photosensitive material processing apparatus capable of processing both long photosensitive materials in the form of a roll (hereinafter referred to as "webs" when applicable) and short photosensitive materials in the form of a sheet or a leaf (hereinafter referred to as "sheets" when applicable). More particularly, the invention relates to a photosensitive material processing apparatus having an improved photosensitive material conveying mechanism.

In general, a sheet processing apparatus employs a roller conveying system. In a processing apparatus of this type, in order to develop, fix, wash and dry a sheet, the sheet is either conveyed through pairs of rollers or it is conveyed by utilizing friction between the sheet and the surfaces of rollers which are arranged staggeredly. In either case, it is necessary that the distance between adjacent conveying rollers be shorter than the minimum length of the sheet and that a number of rollers be provided to perform the above-described processes. For processing webs with such a sheet processing apparatus described above, a web to be processed is normally processed in such a manner that the web extends simultaneously through all of the processing sections, that is, from the inlet of the first processing section to the outlet of the last processing section. In this case, the web is conveyed simultaneously by a number of rollers in the processing sections. Therefore, if the speeds of the rollers are even slightly different, the different speeds result in a slackening of the web as a result of which the web meanders during conveyance. That is, the web may be folded or creased and at worst the web may be wound around the rollers with the result that the web cannot be properly conveyed.

On the contrary, a web processing apparatus is provided with means for supplying a web from a spool on which the web is wound and means for winding the processed web so that a web can be continuously processed. In this case, the web supplying means provides tension to the web by pulling the web backwardly (hereinafter referred to as "back tension" when applicable) while the web winding means provides tension to the web by pulling the web forwardly (hereinafter referred to as "pulling tension" when applicable) so that the web is conveyed under tension through all of the processing sections. An apparatus in which the web conveying speed in the final drying section is made higher than those in the earlier sections in order to increase the pulling tension is also known in the art. The apparatus is based on the same technical concept as that described above.

In an apparatus described for processing only webs and which cannot process sheets, the web is not conveyed by several different sets of conveying rollers. That is, the web is often conveyed only by the pulling tension which is applied to the web by the winding means. In this apparatus, the above-described back tension and pulling tension make it possible to convey the web satisfactorily under tension through all of the processing sections. However, in order for a conventional sheet and web processing apparatus to satisfactorily process sheets, the rollers in all of the processing sections thereof should be provided with driving or conveying power. Because of this requirement, the application of the effects of back tension and pulling tension to a photosensitive material in the processing sections has been limited.

A conventional sheet and web processing apparatus is simply a sheet processing apparatus provided with a web supplying device and a web winding device. It is desirable in such an apparatus that strong back tension and pulling tension be provided to maintain the web under tension in all of the processes. That is, the web should be processed without being slackened.

In order for, according to the above-described technique, the web to be maintained under correct tension at all of the positions in all the processing sections, the following condition must be established:

$$T1+T2>n\cdot t,$$

where T1 is the back tension applied to the web, T2 is the pulling tension, t is the conveying power of each roller, and n is the number of rollers.

This condition implies that the web is acted upon by a tension which is greater than the sum of the conveying powers of all the rollers. In an ordinary processing apparatus, the sum of the conveying powers is higher than the strength of a web itself. Therefore, such a condition cannot be realized. In any event, application of a high tension to a web is not desirable because it is likely to crease the web and to increase the load of the apparatus.

A sheet or a web may be conveyed by a nip conveyance technique using a number of opposed rollers. However, in this case, a problem occurs because of the relation between the width of the rollers and the width of the sheet or web. That is, when the nip conveyance technique is effected using such opposed rollers as described above, in general one roller of a pair of rollers is driven under the condition that a nipping force is applied thereto by a spring and the roller is movable in a plane perpendicular to the direction of passage of a sheet. As a sheet is conveyed through the pair of rollers, the distance between the rollers increases by the thickness of the sheet whereupon the sheet, being nipped by the spring force applied to the rollers, is conveyed onwards. If, in this operation, the sheet is conveyed with straight nip rollers, then all the nipping force would be applied to the surface of the sheet or web.

FIG. 1 illustrates the case where the width of a sheet or web 2 is comparatively large to the width of rollers 1 and 1'. FIG. 2 shows the case where the width of a sheet or web 2 is comparatively small to that of the rollers 1 and 1'. In both cases, the same total nipping force is applied. Therefore, the nip pressure per unit width increases as the width of the sheet or the web 2 decreases. When a conveyed web 2 having a small width passes near the ends of the rollers as shown in FIG. 2, then the upper roller 1' tilts as a result of which the surface pressure applied to the web 2 becomes irregular and therefore the web 2 has a tendency to meander.

As is clear from the above description, with a processing apparatus in which pairs of nip rollers are provided as straight rollers and one of each pair of rollers is depressed by spring means, a web having a small width is especially likely to meander. Moreover, the nipping surface pressure is so great that correction of such induced meandering is difficult.

SUMMARY OF THE INVENTION

Accordingly, an object of this invention is to provide a sheet and web processing apparatus in which the abovedescribed drawbacks have been eliminated and in which even a web of low strength such as a paper web can be satisfactorily processed without meandering, creasing, folding or slackening.

The foregoing object and other objects of the invention has been achieved by the provision of a sheet and web processing apparatus in which pairs of rollers are arranged at short intervals for processing sheets and, for processing a web, all of the portions of the web in various processing sections are conveyed simultaneously by a number of roller groups. In accordance with the invention, the conveyance speeds of the pairs of rollers, for instance, in the developing section, the fixing section, the washing section and the drying section are successively increased in the stated order and a spacing defined by the thickness of a sheet or a web being processed is provided between each pair of rollers whereby, when the web meanders and is subjected to tension, a meandering correcting force is exerted which overcomes the frictional force between the web and the rollers to thereby correct the meandering of the web and to maintain the tension applied to the web at a value less than the strength of the web.

DESCRIPTION OF THE PREFERRED EMBODIMENTS

The invention will be described with reference to its preferred embodiments shown in the accompanying drawings.

Figure 1:
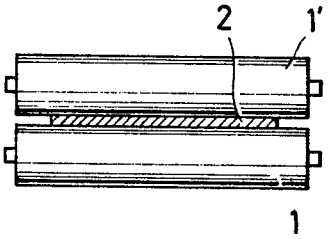
FIG. 1 and FIG. 2 are front views showing sheets or webs conveyed through opposed rollers.
Figure 2:
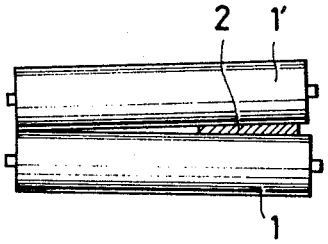
Figure 3:
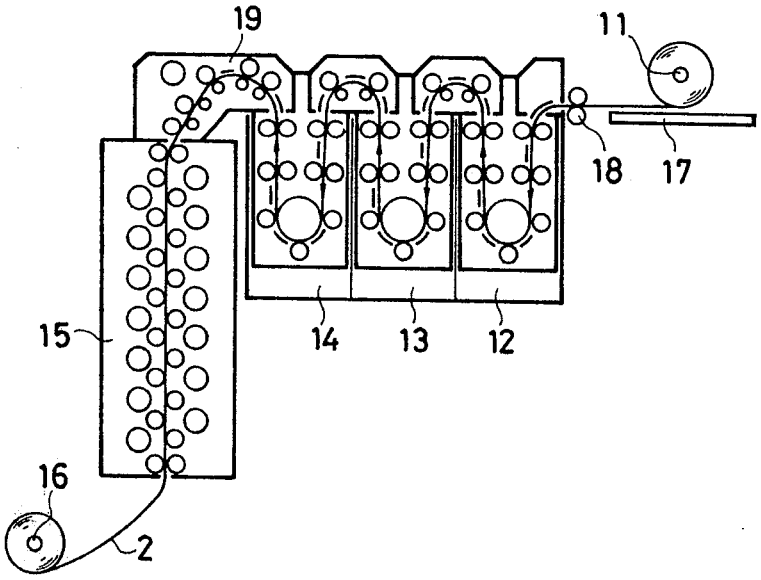
FIG. 3 is a sectional view showing a preferred embodiment of the invention.

A photosensitive material processing apparatus constructed in accordance with a first embodiment of the invention, as shown in FIG. 3, includes a web supplying section 11, a developing section 12, a fixing section 13, a washing section 14, a drying section 15, and a web winding section 16. In this processing apparatus, except for the web supplying section 11 and the web winding section 16, sheets may be processed by feeding them through a sheet inserting stand 17.

A sheet or a web is inserted through a pair of inlet rollers 18 and processed through the developing section 12, the fixing section 13 and the washing section 14. Then, water is removed from the sheet or web by a squeezing section 19 provided at the outlet of the washing section 14. The sheet or web thus treated is conveyed to the drying section 15 where it is dried.

In the above-described processes, the developer, the fixer, the washing water and the drying air are supplied in a circulating manner by means (not shown) with the temperature thereof controlled.

Figure 4:
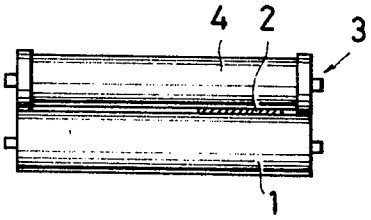
FIG. 4 is a front view showing rollers used in the apparatus shown in FIG. 3.

In the apparatus, conveyance of the sheet or web through the developing section 12, the fixing 13 and the washing section 14 is carried out by opposed rollers which are especially designed as shown in FIG. 4. More specifically, at least one roller 3 of a pair of rollers has a stepped part 4, the height or depth of which is determined by the thickness of a web 2 which is processed so that, even when a web or sheet having a small width is processed, the surface pressure is not increased. The height or depth of the stepped part 4 is effectively 50 to 300% of the thickness of a dried web or sheet, preferably 50 to 200%, and more preferably 50 to 150%.

The use of pairs of rollers 1 and 3 including the rollers 3 having the above-described stepped parts provides the following effects. The nip pressure applied to a web or sheet can be reduced. Even if a web or a sheet meanders, the meandering is corrected by a meandering correcting force. As the nip pressure decreases, the frictional force between the rollers and the web or the sheet is maintained at a low value. Especially in the case of a web, slippage results between the rollers and the web before the tension is excessively increased whereby the tension on the web is maintained at a suitable value.

With the reasonable slippage naturally occurred as described above, the web conveying speed in the developing section, fixing section, the washing section and the drying section can be increased within the range of from 0.1% to 4% making it possible to stably and readily convey the web.

As used herein the phrase web conveying speed refers to the linear speed of the web through a pair of rollers under the condition of no slippage. The conveying speed is determined by the diameter and the rotational speed of the rollers. The actual speed of movement of the web will also depend upon the slippage which is intentionally permitted so that the tension on the web does not become excessive.

Figure 5:
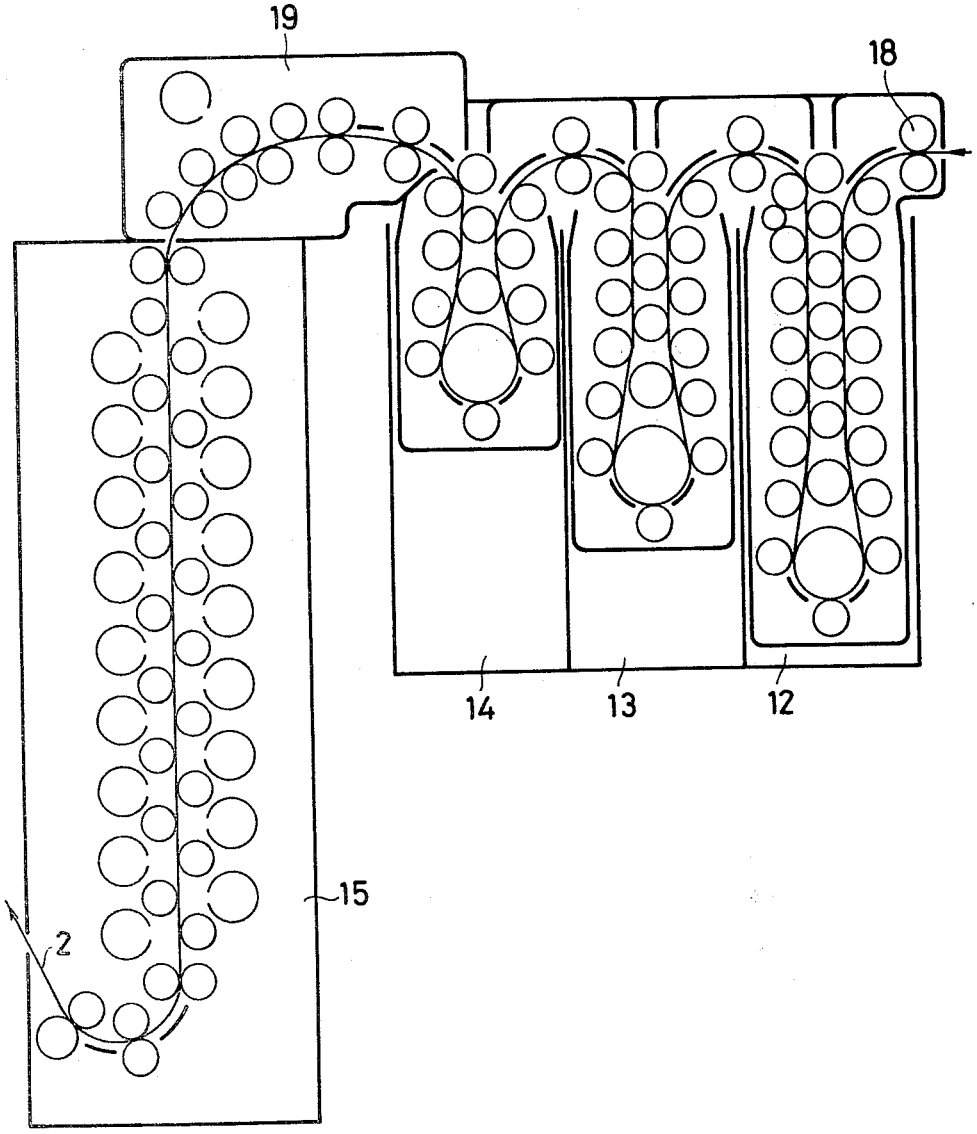
FIG. 5 is a side view showing a second embodiment of the invention.

FIG. 5 shows the essential parts of another embodiment of the invention. Staggeredly arranged rollers are employed mainly in a developing section 12, a fixing section 13 and a washing section 14. The above-described stepped rollers may successfully be employed as the nipping rollers of a turn roller unit provided in the lower portion of each section. The conveying speed is increased as the web advances through the processing sections. In this case particularly, the web conveyance is remarkably improved.

The tension applied to the web by increasing the conveying speed with the advancement of the web can be cancelled by a nip pressure decreasing technique in which the above-described stepped rollers are employed. However, the tension can be more effectively corrected by a technique in which the lower turn roller unit in each section is provided with a one-way clutch so that it can be rotated at a higher speed.

The web conveying speed can be increased from one section to another between the first developing section to the last drying section by a variety of techniques such as by a technique in which rollers are employed whose diameters are successively increased or by a technique in which different drive power transmitting sources are employed.

In an application of the invention to a photographic film processing apparatus, it is essential that the speeds of rollers in the web conveying system extending from the inlet of the developing section to the outlet of the drying section be successively higher. Therefore, the speeds of rollers should be stepwise increased whenever the processing of the web is changed. Alternatively, in each processing section, the speeds of the rollers may be made successively higher. In the former case, the speeds of the rollers in each processing section may be equal to one another. In both of these cases, it is not necessarily requested that in each processing section the speed of rollers in the upstream stage must be lower than the speed of rollers in the downstream stage. That is, if, even in the case where there are rollers whose speeds are higher or lower than the average web conveying speed, the web conveying speed in a later processing section is higher than that in an earlier processing section, then the requirement that all the portions of the web should be under tension can be satisfied.

The use of stepped rollers as described in combination with rollers which are rotated as described above decreases the nip pressure applied to the web and reduces the frictional force between the rollers and the web whereby the meandering correcting force overcomes the frictional force thereby correcting the meandering problem. It is also essential that the differences between the web conveying speeds in processing sections are cancelled by the slippage between the rollers and the web so that the tension is not higher than the strength of the web. However, it is not always necessary that all the stepped rollers have the same depth. That is, the depths of the rollers may be varied within a range of values which meets the above-described requirement. However, in the case where rollers operated at different speeds are arranged in a processing section in which the web conveying speed is maintained unchanged, the amount of slippage increases and, accordingly, the frictional force increases. Therefore, in this case, the stepped rollers must be constructed such that the frictional force is reduced so as not to slacken the web. Cross over rollers and/or squeezing rollers for removing liquid from the web between one section and the next section may be straight rollers. This is due to the fact that at each of the positions of these rollers the sum of the frictional forces of the rollers applied to the web is smaller than the web meandering correcting force which causes slippage between the web and the rollers and, therefore, even if some of the rollers are different in construction, no adverse effect is caused.

In the apparatus shown in FIG. 3, the web turning unit is constructed of a single roller of large diameter and a plurality of rollers of smaller diameters provided therearound. However, the web turning unit may be constructed with a plurality of paired small rollers.

An example of an apparatus constructed in accordance with the teachings of the invention will be described in order to clarify the effects of the invention.

EXAMPLE

In order to increase the web conveying speed between processing sections, that is, so that the web conveying speed in an earlier processing is lower than that in a later processing, rollers having the following diameters were used in the various processing sections with the speed of revolution the same for each.

Developing section: 24.8 mm
Fixing section: 25.0 mm
Washing section: 25.2 mm
Drying section: 25.4 mm With the thickness of a conveyed web which dry was 0.10 mm and the depth of each stepped roller was 0.10 mm, the web conveyance was carried out satisfactorily.

What is claimed is:

1. An apparatus for processing a material in the form of a sheet or a web: comprising pairs of rollers arranged at short intervals for conveying said material through successive order processing sections, the rotational speeds and diameters of said rollers having values resulting in web conveyance speeds of said pairs of rollers which are greater for roller pairs in the downstream processing sections than in the upstream processing sections, said roller pairs also being arranged to provide a distance between the rollers of a given pair, even in the absence of a web or sheet, which distance is sufficiently small to result in a frictional force on said web or sheet when passing through said roller pairs, while at the same time permitting slippage of the web or sheet relative to the conveyance speed of any pair of rollers, the increasing conveyance speed providing tension on said web or sheet and the distance between rollers of a given pair providing sufficient slippage to insure that the said tension does not exceed the strength of the web and to permit correction of meandering by a correcting force which overcomes the frictional force between the web and the rollers.

2. The processing apparatus of claim 1 wherein the diameters of at least predetermined ones of said pairs of rollers are increased monotonically as said material passes through said successive ordered processing sections.

3. The processing apparatus of claim 1 wherein predetermined ones of said rollers in each of said processing sections is provided with a one-way clutch.

4. The processing apparatus of claim 1 wherein said rollers have a constant diameter among said processing sections and wherein the speed of rotation of said rollers is increased monotonically as said material passes through said successive ordered processing sections.

5. The processing apparatus of claim 1 wherein said distance between the rollers of a given roller pair is provided by at least one of said rollers of said pair having a stepped portion resulting in a large diameter section in contact with the other roller of said pair, and a small diameter section, which contacts said web or sheet when either is present, not in contact with said other roller even in the absence of said web or sheet.

6. The processing apparatus of claim 5 wherein the height of said stepped part is effectively 50 to 300% of the thickness of said material in the dry state.

7. The processing apparatus of claim 5 wherein the height of said stepped part is effectively 50 to 200% of the thickness of said material in the dry state.

8. The processing apparatus of claim 5 wherein the height of said stepped part is effectively 50 to 150% of the thickness of said material in the dry state.

* * * * *